US005120240A

United States Patent [19]

Reider

[11] Patent Number: 5,120,240

[45] Date of Patent: Jun. 9, 1992

[54] ELECTRICAL CONNECTOR WITH IMPROVED CONNECTOR POSITION ASSURANCE DEVICE

[75] Inventor: Christopher G. Reider, Youngstown, Ohio

[73] Assignee: General Motors Corporation, Detroit, Mich.

[21] Appl. No.: 754,513

[22] Filed: Sep. 3, 1991

[51] Int. Cl.[5] ..... H01R 13/73

[52] U.S. Cl. ..... 439/352; 439/358

[58] Field of Search ..... 439/301, 304, 489, 350–358

[56] References Cited

U.S. PATENT DOCUMENTS

| | | | |
|---|---|---|---|
| 4,370,013 | 1/1983 | Niitsu et al. | 339/82 |
| 4,634,204 | 1/1987 | Detter et al. | 339/91 R |
| 4,708,413 | 11/1987 | Schroeder | 439/358 |
| 4,714,433 | 12/1987 | Rider, Jr. | 439/359 |
| 4,746,306 | 5/1988 | Yurtin et al. | 439/357 |
| 4,906,204 | 3/1990 | Metzger | 439/352 |
| 4,946,395 | 8/1990 | Cope et al. | 439/352 |
| 4,946,402 | 8/1990 | Fink et al. | 439/274 |
| 4,950,175 | 8/1990 | Plyler et al. | 439/274 |
| 4,950,179 | 8/1990 | Takenouchi et al. | 439/352 |
| 4,963,103 | 10/1990 | Fink et al. | 439/352 |

*Primary Examiner*—Larry I. Schwartz
*Assistant Examiner*—Hien D. Vu
*Attorney, Agent, or Firm*—Francis J. Fodale

[57] ABSTRACT

An electrical connector has a pump handle lock arm that provides a forward lock arm for locking the electrical connector to a mating electrical connector and a rearward release handle that is depressible to unlock the lock arm, and a connector position assurance device that has a tongue that fits beneath the release handle to assure proper engagement of the lock arm. The tongue of the connector position assurance device has its opposite lateral sides integrally connected to respective laterally spaced, rib stiffened runners for installing the connector position assurance device onto the electrical connector and it is shaped so that the tongue and runners are sufficiently rigid to prevent installation on the pump handle lock arm when the electrical connector is not properly mated to the mating electrical connector.

9 Claims, 2 Drawing Sheets

ELECTRICAL CONNECTOR WITH IMPROVED CONNECTOR POSITION ASSURANCE DEVICE

BACKGROUND OF THE INVENTION

This invention relates generally to electrical connectors and more specifically to electrical connectors which have a connector position assurance device to assure that mating electrical connectors are properly mated and locked together.

Electrical connectors which have such devices are already known in the prior art. See for instance U.S. Pat. No. 4,764,306 (Yurtin et al); U.S. Pat. No. 4,708,413 (Schroeder); U.S. Pat. No. 4,634,204 (Detter et al) and U.S. Pat. No. 4,370,013 (Niitsu et al); U.S. Pat. No. 4,906,204 (Metzger); U.S. Pat. No. 4,946,395 (Cope et al); U.S. Pat. No. 4,946,402 (Fink et al); U.S. Pat. No. 4,950,175 (Plyler et al); and U.S. Pat. No. 4,963,103 (Fink et al).

It is also known to provide electrical connectors with a "pump handle" lock arm, that is, a lock arm which is hinged or pivotally connected to the electrical connector midway between its ends. In such an arrangement, the forward end of the pump handle lock arm acts as the lock member while the rearward end acts as a release handle. When the release handle is depressed, the lock member is pivoted out of engagement with a cooperating lock nib of the mating connector. Electrical connectors having a connector position assurance device which operates in conjunction with a pump handle lock arm are disclosed in U.S. Pat. No. 4,708,413 (Schroeder); U.S. Pat. No. 4,946,402 (Fink et al); U.S. Pat. No. 4,950,175 (Plyler et al); and U.S. Pat. No. 4,963,103 (Fink et al) which are mentioned above.

The connector position assurance device that is disclosed in U.S. Pat. No. 4,946,402 (Fink et al) and U.S. Pat. No. 4,963,103 (Fink et al) comprises a tongue (114) that is sized to fit in a longitudinal groove (110) of the release handle portion of the pump handle lock arm when the lock arm is disposed in a properly locked position. The connector position device further includes a lock arm (116) that cooperates with a lock shoulder (108) of the release handle to lock the connector position assurance device in position.

This arrangement has some drawbacks. One drawback is that the interference between the tongue and the end of the release handle when the pump handle lock arm is cocked does not produce high resistance. This resistance that is produced is not sufficient to complete engagement of partially engaged electrical connectors nor is it sufficient to prevent improper installation of the connector position device in all instances. Thus it is possible to install the connector position device on partially engaged connectors thereby giving an illusion of the partially engaged connectors being fully mated. Another drawback is that it is possible to pre-install the connector position assurance device and then subsequently partially engage the electrical connectors.

SUMMARY OF THE INVENTION

The object of this invention is to provide an improved connector position assurance device for an electrical connector that has a pump handle lock arm.

A more specific object of this invention is to improve the connector position assurance arrangement disclosed in U.S. Pat. No. 4,946,402 (Fink et al) and U.S. Pat. No. 4,963,103 (Fink et al).

A feature of the invention is that the improved connector position assurance device has a tongue that is shaped and incorporated into the connector position assurance device so that it reacts with an interfering release handle to produce a substantial resistance which prevents installation of the connector position assurance device on improperly mated electrical connectors.

Another feature of the invention is that the connector position assurance device has a relatively rigid tongue that cooperates with a pump handle lock arm to prevent improper installation of the connector position assurance device and the illusion of partially mated connectors being fully mated.

Other objects and features of the invention will become apparent to those skilled in the art as disclosure is made in the following detailed description of a preferred embodiment of the invention which sets forth the best mode of the invention contemplated by the inventor and which is illustrated in the accompanying sheet(s) of drawing.

DETAILED DESCRIPTION OF THE PREFERRED EMBODIMENT

Figure 1:
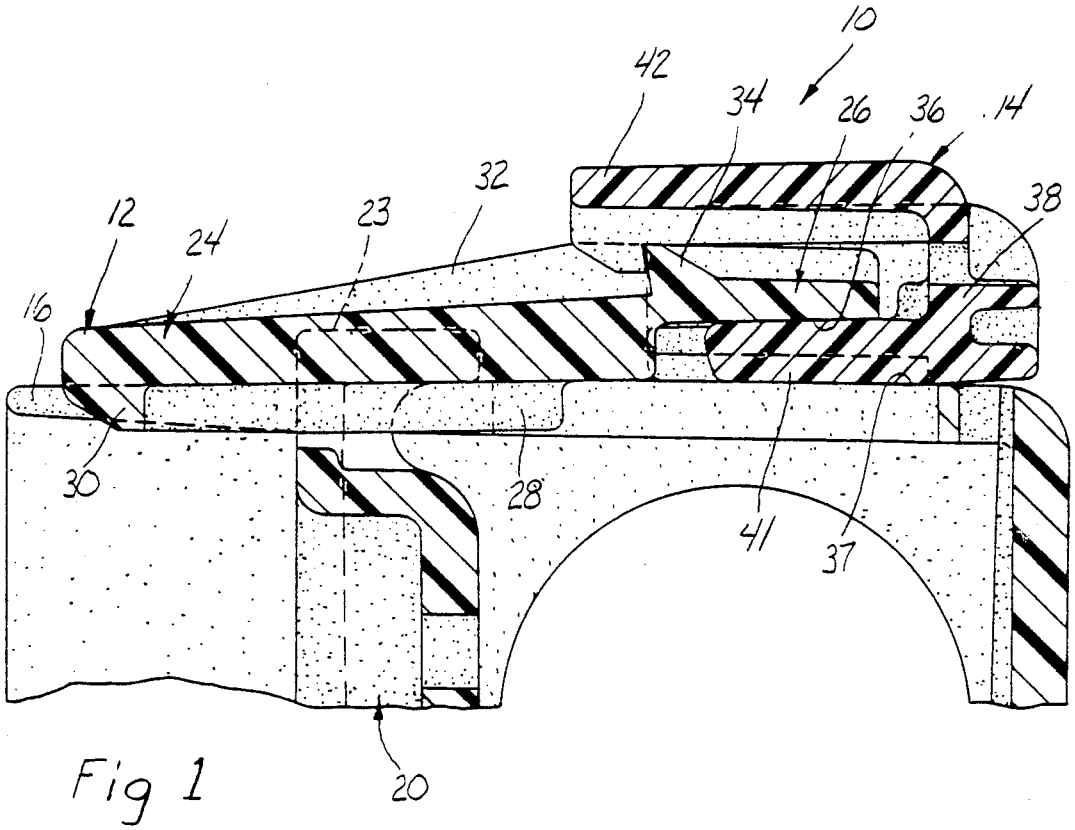
FIG. 1 is a fragmentary longitudinal cross section view of an electrical connector having an improved connector position assurance device of this invention illustrated in an installed position.
Figure 2:
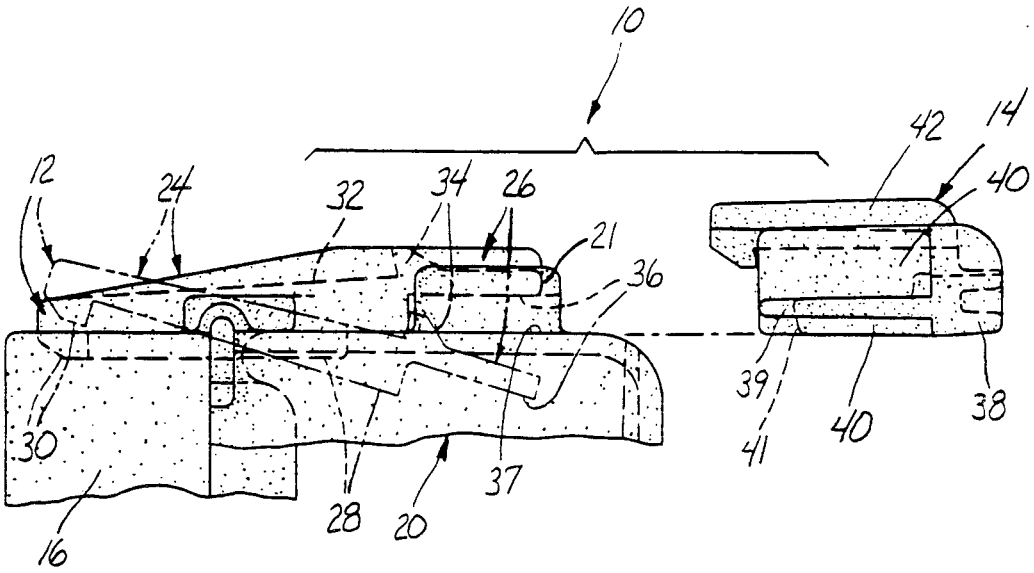
FIG. 2 is a fragmentary side view of the electrical connector having the improved connector position assurance device of this invention illustrated in an exploded uninstalled position.
Figure 3:
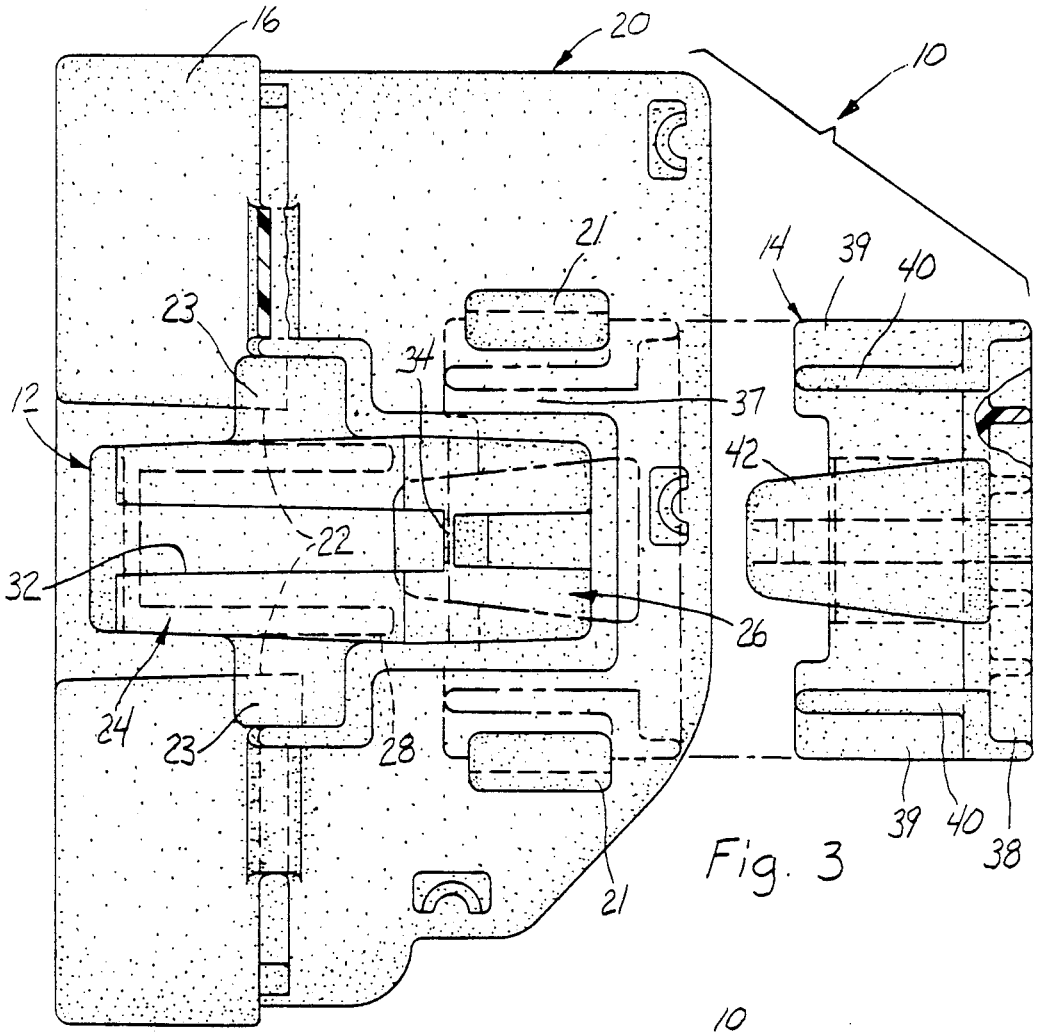
FIG. 3 is a fragmentary top view of the electrical connector and the uninstalled improved connector assurance position device illustrated in FIG. 2.

Referring now to the drawing, FIGS. 1 through 4 show fragmentary views of an electrical connector 10 having a pump handle lock arm 12 for locking the electrical connector in fully mated engagement with a mating electrical connector (not shown) and a connector position assurance device 14 that is installed on the pump handle lock arm to assure that the electrical connectors are properly locked in full mating engagement. The installed connector position assurance device also prevents inadvertent depression of the release handle which unlocks the pump handle lock arm. This general arrangement is disclosed and claimed in the prior art U.S. Pat. No. 4,963,103 granted to Randy L. Fink and Bruce J. Serbin Oct. 16, 1990 which is incorporated herein by reference.

The pump handle lock arm 12 is attached to an annular wall 16 of a back shell 20 by integral hinges 22 depending from lateral wings 23. The back shell 20 forms part of the electrical connector 10 which is described in detail along with the details of a mating electrical connector in U.S. Pat. No. 4,963,103. Since this patent is incorporated by reference many of these details are not repeated here focusing instead on the details of the pump handle lock arm 12 and connector position assurance device 14.

Figure 4:
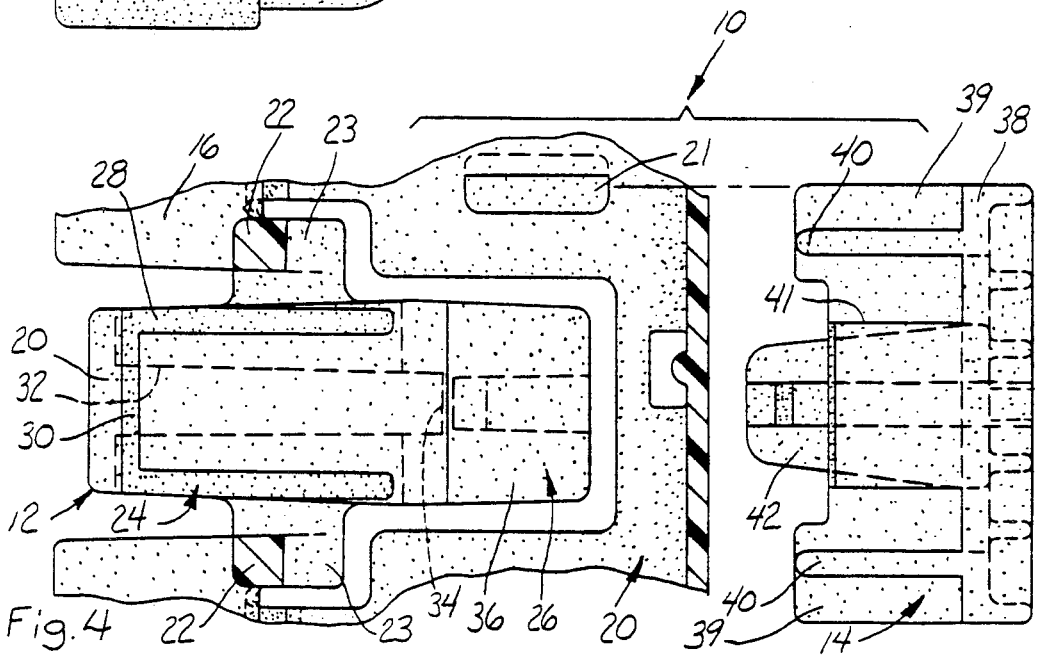
FIG. 4 is a fragmentary transverse cross section view of the electrical connector illustrating the bottoms of the uninstalled improved connector position assurance device and the pump handle lock arm.

The pump handle lock arm 12 is divided by the integral hinges 22 into a forward lock arm 24 and a rearward release handle 26. The lock arm 24 has a trapezoidal longitudinal cross section and a depending U-shaped or peripheral flange 28 that extends past the integral hinges 22 for a short distance onto the bottom of the release handle 26 as best shown in FIG. 4. These features increase stiffness and result in a relatively rigid lock arm 24 that does not flex up independently of the action of the integral hinges 22. The front wall of the flange 28 forms a catch 30 that cooperates with a nib of the mating electrical connector (not shown) to lock the mating electrical connectors together in a fully mated position.

The pump handle lock arm 12 has a longitudinal groove 32 that extends the length of its upper surface. The longitudinal groove 32 is divided by a transverse lock shoulder or rib 34 disposed in the groove portion which is in the release handle 26 behind the integral hinges 22. The release handle 26 has a flat raised bottom 36 at its free end that extends for the full width of the release handle 26. The installed connector assurance device 14 cooperates with the bottom 36 and a vertically spaced confronting surface 37 of the electrical connector 10 as shown in FIG. 1.

The connector position assurance device 14 itself comprises a rearward transverse body 38 that supports a pair of laterally spaced, longitudinal runners 39. The runners 39 fit and slide in laterally spaced, flanged rails 21 formed on an upper surface of a hinged upper clam shell that forms part of the back shell 20 that in turn forms part of the electrical connector 10. The body 38 and runners 39 have vertical stiffening ribs 40. The stiffening ribs 40 are longitudinally oriented on the runners 39 and also serve as installation guides.

The connector position assurance device 14 further includes a tongue 41 that fits between the raised bottom 36 at the free end of the release handle 26 and the confronting surface 37 when the electrical connector 10 is fully engaged with a mating electrical connector and the pump handle lock arm 12 is disposed in a properly locked position as shown in FIG. 1. The connector position assurance device 14 also includes a lock arm 42 that cooperates with the lock shoulder 34 to lock the connector position assurance device 14 in the installed position shown in FIG. 1.

The tongue 41 extends longitudinally from the lateral body 38 and is nearly as long as the runners 39. The tongue 41 is nearly as wide as the free end of the release handle 26 and its opposite lateral sides are integrally connected to the respective runners 39 so that the tongue 41 as well as the runners 39 form a relatively rigid part of the connector position assurance device 14. This rigidity and the wide shape of the tongue 41 produces a substantial resistance when the tongue 41 reacts with the free end of the release handle 26 when it is in an interfering position which is the case when the electrical connectors are partially or improperly mated and the pump handle lock arm 12 is cocked as shown in dashed lines in FIG. 2. This resistance is sufficient to prevent installation of the connector position assurance device 14 or alternatively it requires an installation force that is sufficient to complete the engagement of partially engaged electrical connectors during the installation process.

Thus the improved connector position assurance arrangement of this invention prevents the illusion of partially mated electrical connectors being fully mated.

I wish it to be understood that I do not desire to be limited to the exact details of construction shown and described, for obvious modifications will occur to a person skilled in the art.

The embodiments of the invention in which an exclusive property or privilege is claimed are defined as follows:

1. In an electrical connector having a pump handle lock arm which is hinged to a connector body of the electrical connector midway between its ends to provide a forward lock arm for locking the electrical connector to a mating electrical connector and a rearward release handle which is depressible to pivot the lock arm out of engagement with a cooperating lock nib of a mating electrical connector and a connector position device that has a tongue that fits beneath the release handle to assure proper engagement of the lock arm and prevent depression of the release handle and laterally spaced runners for installing the connector position assurance device onto the electrical connector, the improvement comprising:

the tongue of the connector position assurance device having opposite lateral sides that are integrally connected to the respective laterally spaced runners for installing the connector position assurance device onto the electrical connector so that the tongue and runners are sufficiently rigid to prevent installation on the pump handle lock arm when the electrical connector is not properly mated to the mating electrical connector.

2. The electrical connector as defined in claim 1 wherein the improvement further comprises:

the release handle has a free end, and the tongue of the connector position assurance device being nearly as wide as the free end of the release handle.

3. The electrical connector as defined in claim 1 wherein the improvement further comprises:

the tongue of the connector position assurance device being nearly as long as the runners.

4. The electrical connector as defined in claim 1 wherein the improvement further comprises:

the runners being supported by a rigid body of the connector position assurance device and having vertical stiffening ribs.

5. In an electrical connector having a pump handle lock arm which is hinged to a connector body of the electrical connector midway between its ends to provide a forward lock arm for locking the electrical connector to a mating electrical connector and a rearward release handle which is depressible to pivot the lock arm out of engagement with a cooperating lock nib of a mating electrical connector and a connector position assurance device that has a tongue that fits beneath the release handle to assure proper engagement of the lock arm and prevent depression of the release handle and laterally spaced runners for installing the connector position assurance device onto the electrical connector, the improvement comprising:

the runners being supported by a rigid body of the connector position assurance device and having vertical stiffening ribs, and the tongue of the connector position assurance device having opposite lateral sides that are integrally connected to the respective laterally spaced runners for installing the connector position assurance device onto the electrical connector whereby the tongue and the runners are sufficiently rigid to prevent installation on the pump handle lock arm when the electrical connector is not properly mated to the mating electrical connector.

6. The electrical connector as defined in claim 5 wherein the improvement further comprises:

the release handle having a raised flat bottom at its free end, and the tongue of the connector position assurance device being nearly as wide as the free end of the release handle.

7. The electrical connector as defined in claim 5 wherein the improvement further comprises:

the tongue of the connector position assurance device being nearly as long as the runners.

8. In an electrical connector having a pump handle lock arm which is hinged to a connector body of the electrical connector midway between its ends to provide a forward lock arm for locking the electrical connector to a mating electrical connector and a rearward release handle which is depressible to pivot the lock arm out of engagement with a cooperating lock nib of a mating electrical connector and a connector position assurance device that has a tongue that fits beneath the release handle to assure proper engagement of the lock arm and prevent depression of the release handle and laterally spaced runners for installing the connector position assurance device onto the electrical connector, the improvement comprising:

the runners being supported by a body and the runners and body having vertical stiffening ribs, and the tongue of the connector position assurance device being shaped and having opposite lateral sides that are integrally connected to the respective laterally spaced runners for installing the connector position assurance device onto the electrical connector whereby the tongue and the runners are sufficiently rigid to prevent installation on the pump handle lock arm when the electrical connector is not properly mated to the mating electrical connector.

9. The electrical connector as defined in claim 8 wherein the improvement further comprises:

the release handle having a raised flat bottom at its free end, and the tongue of the connector position assurance device being nearly as wide as the free end of the release handle and nearly as long as the runners.

* * * * *